US006418587B1

(12) United States Patent
Kent et al.

(10) Patent No.: US 6,418,587 B1
(45) Date of Patent: Jul. 16, 2002

(54) CLEANING TOOL

(75) Inventors: Roger Kent, Plano, TX (US); Rodney D. Maddox; Frank Stephan, both of Fenton, MO (US); William B. Kennedy, Webster Groves, MO (US)

(73) Assignee: Rug Doctor, L.P., Plano, TX (US)

( * ) Notice: Subject to any disclaimer, the term of this patent is extended or adjusted under 35 U.S.C. 154(b) by 0 days.

(21) Appl. No.: 09/565,221

(22) Filed: May 5, 2000

(51) Int. Cl.[7] ..... A47L 9/02
(52) U.S. Cl. ..... 15/322; 15/244.1
(58) Field of Search ..... 15/220.1, 244.1, 15/244.2, 321, 322, 416, 417

(56) References Cited

U.S. PATENT DOCUMENTS

| | | | | |
|---|---|---|---|---|
| 965,315 A | | 7/1910 | Moorhead | |
| 1,042,713 A | | 10/1912 | Moorhead | |
| 1,740,001 A | * | 12/1929 | Carlstedt | |
| 2,240,005 A | * | 4/1941 | Moyer | |
| 2,506,077 A | | 5/1950 | Goldsmith | 15/130 |
| 2,805,435 A | | 9/1957 | Boscarino, Jr. | 15/131 |
| 2,885,713 A | | 5/1959 | Morrill | 15/322 |
| 2,893,044 A | | 7/1959 | Kurose | 15/322 |
| 3,074,100 A | | 1/1963 | Sherbondy | 15/569 |
| 3,135,986 A | | 6/1964 | Tolin | 15/375 |
| 3,184,780 A | * | 5/1965 | Hageman | |
| 3,195,166 A | | 7/1965 | Wisner | 15/321 |
| 3,258,809 A | * | 7/1966 | Harvey | |
| 3,259,933 A | * | 7/1966 | Clause | |
| 3,281,885 A | * | 11/1966 | Hersh | |
| 3,538,535 A | * | 11/1970 | Ginsburgh | |
| 3,591,889 A | | 7/1971 | Wisner | 15/321 |
| 3,747,155 A | | 7/1973 | Koellisch | 15/322 |
| 3,787,919 A | | 1/1974 | Siemund | 15/244 CH |
| 4,077,083 A | | 3/1978 | Siemund et al. | 15/244 R |
| 4,170,805 A | * | 10/1979 | Kumagai | |
| 4,270,238 A | | 6/1981 | Shallenberg et al. | 15/321 |
| 4,437,203 A | * | 3/1984 | Wisner | |
| 4,864,677 A | * | 9/1989 | Levy | |
| 4,879,784 A | | 11/1989 | Shero | 15/322 |
| 5,301,387 A | * | 4/1994 | Thomas et al. | |
| 5,331,709 A | * | 7/1994 | Hudson | |
| 5,400,467 A | * | 3/1995 | Hwang | |

FOREIGN PATENT DOCUMENTS

| | | |
|---|---|---|
| EP | 0642758 | 3/1995 |
| EP | 0747001 | 12/1996 |
| GB | 0943711 | 12/1963 |

OTHER PUBLICATIONS

Videotape; Rapid System Product Demo, Ceiling Cleaning, T. Vansholtz, editor, date Jun. 22, 1997, 7.15 minutes.

* cited by examiner

*Primary Examiner*—Terrence R. Till
(74) *Attorney, Agent, or Firm*—Thompson Coburn LLP; Grant D. Kang; David R. Deal

(57) ABSTRACT

The invention is a cleaning tool housing assembly and a replaceable cleaning assembly. The manifold, in combination with a fluid intake element, also delivers fluid (under pressure through holes in the manifold located in a longitudinal channel) to a sponge. Two spaced apart fluid barriers are longitudinally disposed in the sponge. As fluid is introduced into the center of the sponge, between the fluid barriers, the fluid travels toward the opposite surface of the sponge. The fluid is prevented from traveling laterally due to the fluid barriers. As vacuum pressure, negative pressure, is exerted on the outer portions of the sponge (on each side of the fluid barriers), fluid is pulled back through the sponge, through the manifold and through the nozzles into the hollow housing body.

15 Claims, 4 Drawing Sheets

CLEANING TOOL

FIELD OF THE INVENTION

This invention relates to cleaning tools and, in particular, to cleaning tools for use on floors, walls and ceilings. The cleaning tool has a replaceable cleaning assembly.

BACKGROUND OF THE INVENTION

The prior art has a number of devices that provide various means of applying cleaning solution to a surface to be cleaned and scrubbed. The prior art further provides various means of removing the cleaning solution. Application of the cleaning solution may be by direct spray, application through a bristle brush, and application through the body of a sponge. Removal of the cleaning solution may be by squeegee and vacuum combination, vacuum without squeegee, and vacuum applied through some other structural element.

U.S. Pat. No. 3,195,165 discloses a wall washing tool having a wall contacting head which includes three side-by-side longitudinal sponge pads separated by barrier members so that the vacuum drawn through the side pads will not affect the center pad. Vacuum apertures are provided in the side sections. Leaking and dripping is a problem, as weep holes have been added in the center section.

U.S. Pat. No. 3,591,889 illustrates a later version of a sponge pad cleaning head, wherein the sponge has longitudinal slots receiving sidewalls therein for retention purposes. The sponge pad is a single element with various apertures or bores for permitting fluid to pass to the cleaning surface.

These prior art inventions have a problem in that droplets and dripping results. Such droplet formation or dripping is undesirable. For example, when droplets or ripping is assured, furniture and equipment and floors must all be covered prior to leaning. The process for covering important items is very time consuming, and much time and money could be saved if these problems are eliminated.

SUMMARY OF THE INVENTION

The invention is a cleaning tool housing assembly and a replaceable cleaning element assembly. The housing assembly provides dual tapered nozzles to exert negative pressure through a manifold to pull fluid from a sponge. The manifold, in combination with a fluid intake element, also delivers fluid (under pressure through holes in the manifold located in a longitudinal channel) to a sponge. Two spaced apart fluid barriers are longitudinally disposed in the sponge. As fluid is introduced into the center of the sponge, between the fluid barriers, the fluid travels toward the opposite surface of the sponge. The fluid is prevented from traveling laterally due to the fluid barriers. As vacuum pressure, negative pressure, is exerted on the outer portions of the sponge (on each side of the fluid barriers), fluid is pulled back into the manifold, into the nozzles.

The gasket performs, among other things, the function of providing a seal between the pressurized outgoing fluid and the pulled incoming fluid.

The dual nozzle housing of the present invention provides a greater and more forceful vacuum (less loss) due to the geometry of each nozzle, including the relatively small size of and decreasing cross sectional area of the openings within the nozzles.

DESCRIPTION OF THE PREFERRED EMBODIMENT

Figure 1:
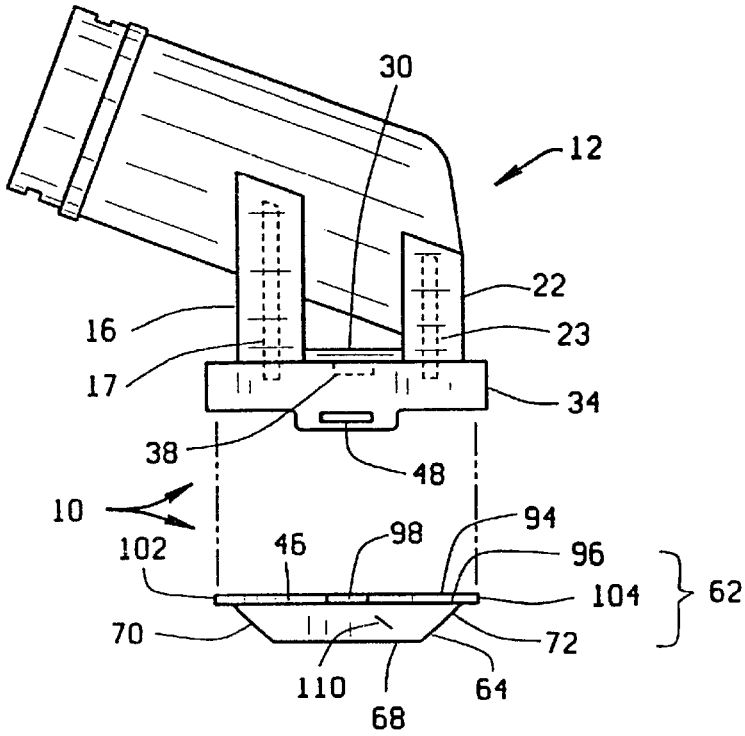
FIG. 1 is a side exploded view of the cleaning tool housing assembly and the replaceable cleaning assembly of the present invention.
Figure 2:
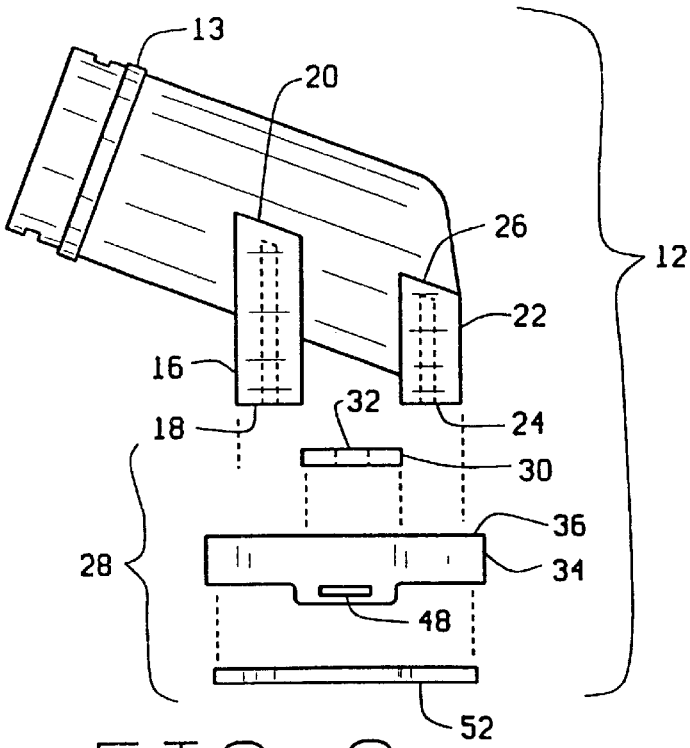
FIG. 2 is a side exploded view of the cleaning tool housing assembly of the present invention.

The invention will be described with reference to the drawings, in which like numbers designate like elements. FIG. 1 illustrates a side exploded view of the present invention illustrating the cleaning tool, shown generally at 10, which comprises cleaning tool housing assembly shown generally at 12 and replaceable cleaning assembly shown generally at 62.

As best shown in FIGS. 1, 2, 3, 4, 5A, 5B, and 5C, cleaning tool housing assembly 12 comprises hollow cleaning tool housing body 14 equipped with fitting 13, first nozzle 16, second nozzle 22, and manifold assembly 28. First nozzle 16 is provided with first end 18, second end 20, and opening 17 disposed between first end 18 and second end 20. Opening 17 is in fluid communication with the interior of hollow cleaning tool housing body 14. Similarly, second nozzle 22 is provided with first end 24, second end 26, and opening 23 disposed between first end 24 and second end 26. Opening 23 of second nozzle 22 is in fluid communication with the interior of hollow cleaning tool housing body 14. Preferably, cleaning tool housing 14 and nozzles, 16 and 22, are made from a relatively rigid material such as plastic, so that the tool can be used without a significant flexing of housing body 14 or nozzles 16 or 22.

Figure 3:
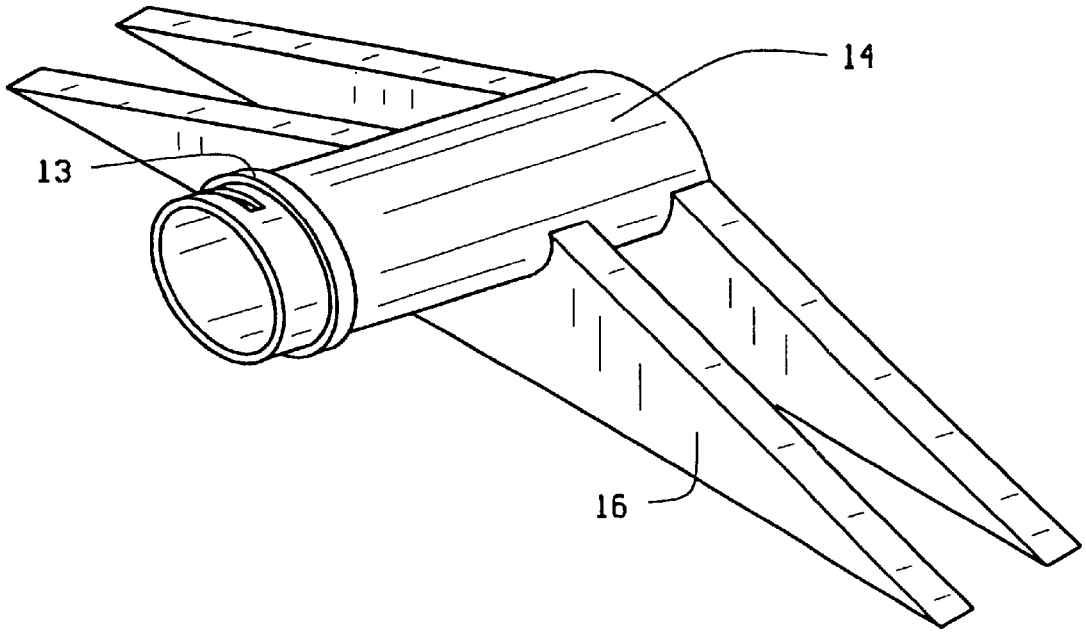
FIG. 3 is an elevated perspective view of the cleaning tool housing of the present invention.
Figure 4:
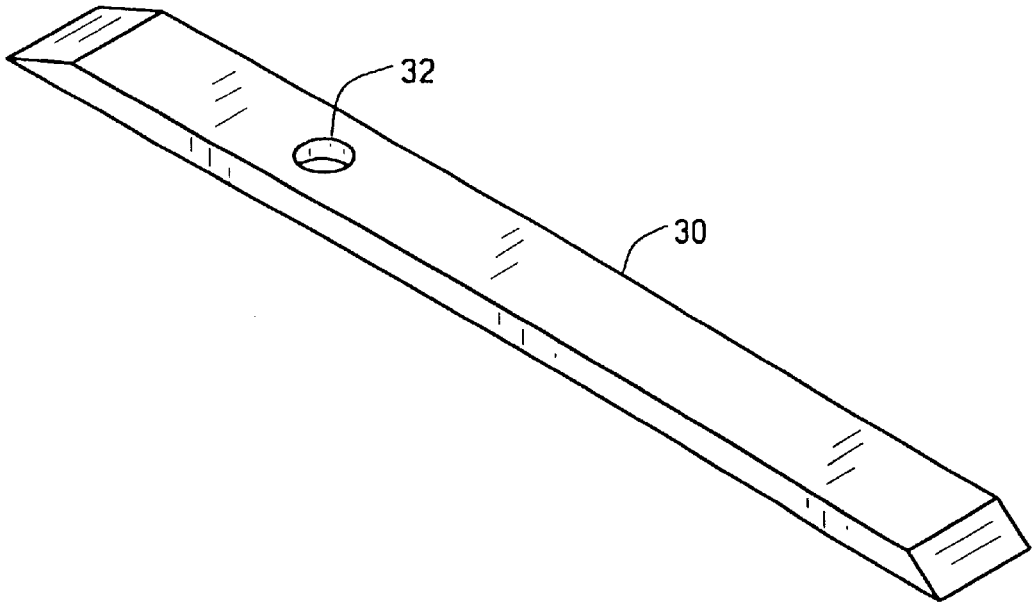
FIG. 4 is an elevated perspective view of the fluid intake element of the present invention.

As can be seen best from FIG. 3, at the first end 18 of first nozzle 16, opening 17 has an area which is larger than the area of the opening 17 at the second end 20 of first nozzle 16. Similarly, opening 23 at the first end 24 of second nozzle 22 has a larger area than the area of opening 23 at the second end 26 of second nozzle 22. In other words, the openings 17 and 23 decrease in cross-sectional area going from the first to the second ends of the nozzles 16 and 22. This difference in area enhances the ability of cleaning tool 10 to exert substantially consistent negative pressure across the longitudinal bottom surface 68 of the sponge 64 by increasing the velocity of fluid traveling through nozzles 16 and 22 within Openings 17 and 23.

Figure 5A:
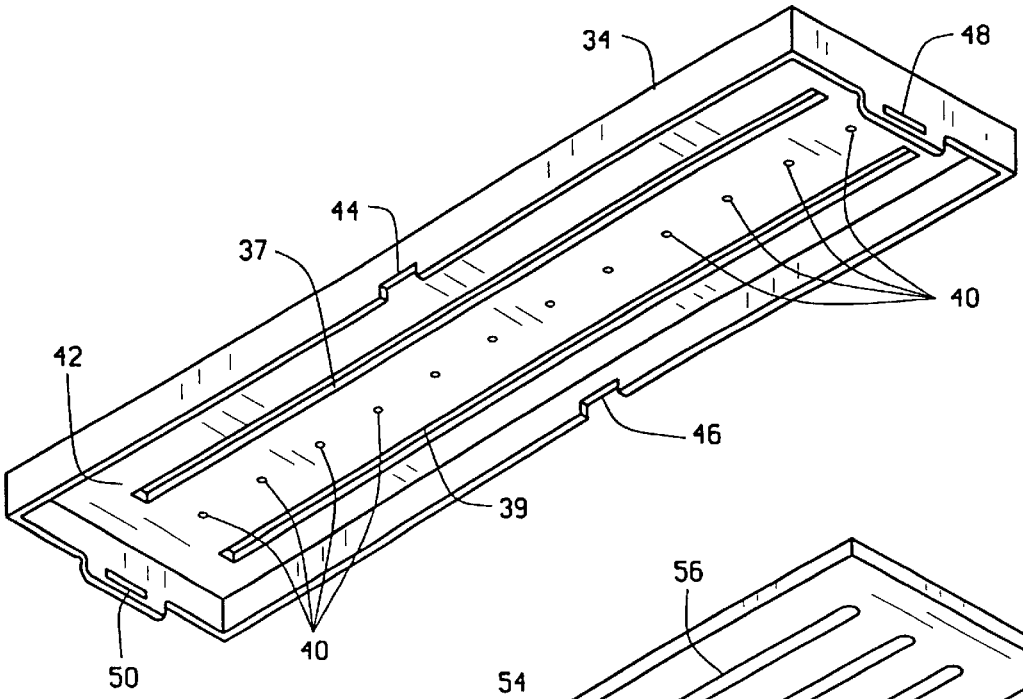
FIG. 5A is a lower perspective view of the manifold of the present invention.
Figure 5B:
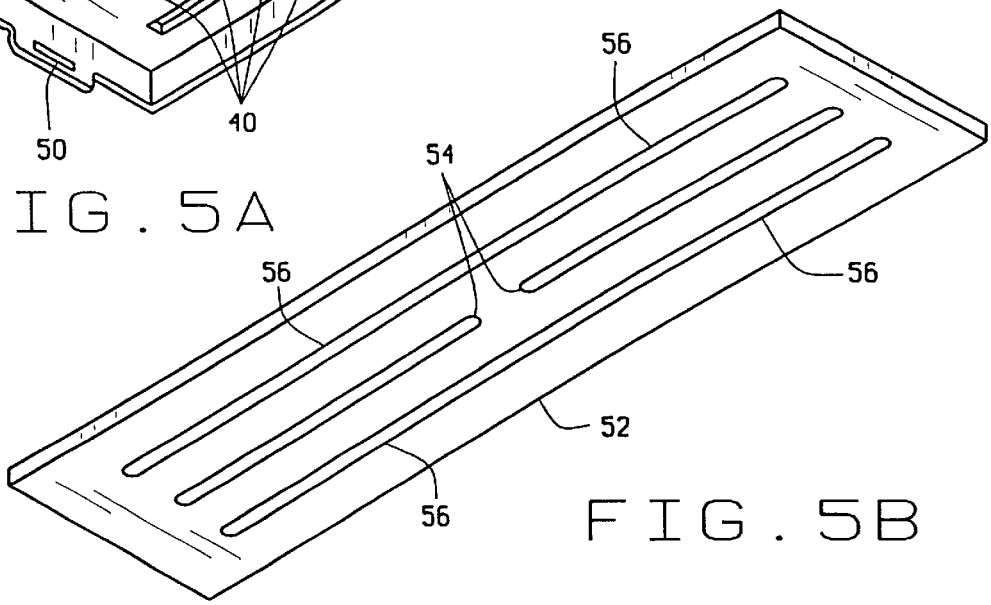
FIG. 5B is a lower perspective view of the gasket of the present invention.
Figure 5C:
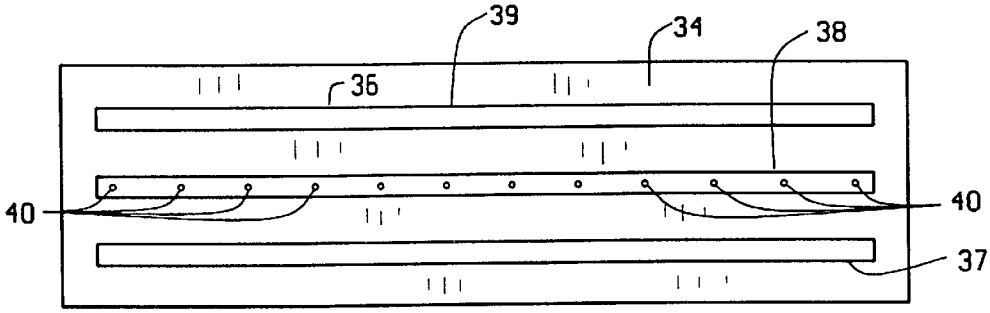
FIG. 5C is a top plan view of the manifold of the present invention.

Manifold assembly shown generally at 28 comprises fluid intake element 30, manifold body 34, and gasket 52. Fluid intake element 30 defines a threaded hole 32 for connection to a source of pressurized cleaning fluid. Manifold body 34 has top surface 36, first longitudinal opening 37, longitudinal channel 38, second longitudinal opening 39, at least one hole 40, bottom surface 42, first side gap 44, second side gap 46, first end hole 48 and second end hole 50. Gasket 52 is provided with at least one fluid delivery opening 54 and at least two fluid suction openings 56. Preferably, manifold body 34 and fluid intake element 30 are made from a relatively rigid material, just as the housing 14. Preferably, fluid intake element 30 is chamfered at its ends to prevent snagging during use. Fluid intake element 30 is disposed directly above longitudinal channel 38 of manifold body 34. Gasket 52 is preferably a closed cell rubber, with pressure sensitive adhesive on one side to assist in the fixation of gasket 52 to bottom surface 42 of manifold body 34. Although manifold body 34 is shown in FIG. 5A with a plurality of serially spaced, longitudinally oriented holes 40, this element may be comprised of alternate suitable arrangements including, but not limited to a single thin longitudinal hole in the manifold body 34. Similarly, although the longitudinal openings 37 and 38 are shown as longitudinal slits, these elements may be comprised of alternated arrangements as well, including but not limited to, a plurality of serially spaced, longitudinally oriented holes.

Fluid delivery openings 54 of gasket 52 are in fluid communication with holes 40 of longitudinal channel 38, which is in fluid communication with fluid intake element 30.

Fluid suction openings 56 of gasket 52 are in fluid communication with first and second longitudinal openings 37 and 39, respectively, which are in fluid communication with openings, 17 and 23, respectively, of first and second nozzles, 16 and 22, respectively. Although most elements of the housing assembly 12 and other aspects of the invention are shown as separate, they may be combined into one or more unitary parts. For example, body 14, nozzles 16 and 22, fluid intake element 30 and manifold body 34 may be a single molded or cast plastic part.

Figure 6:
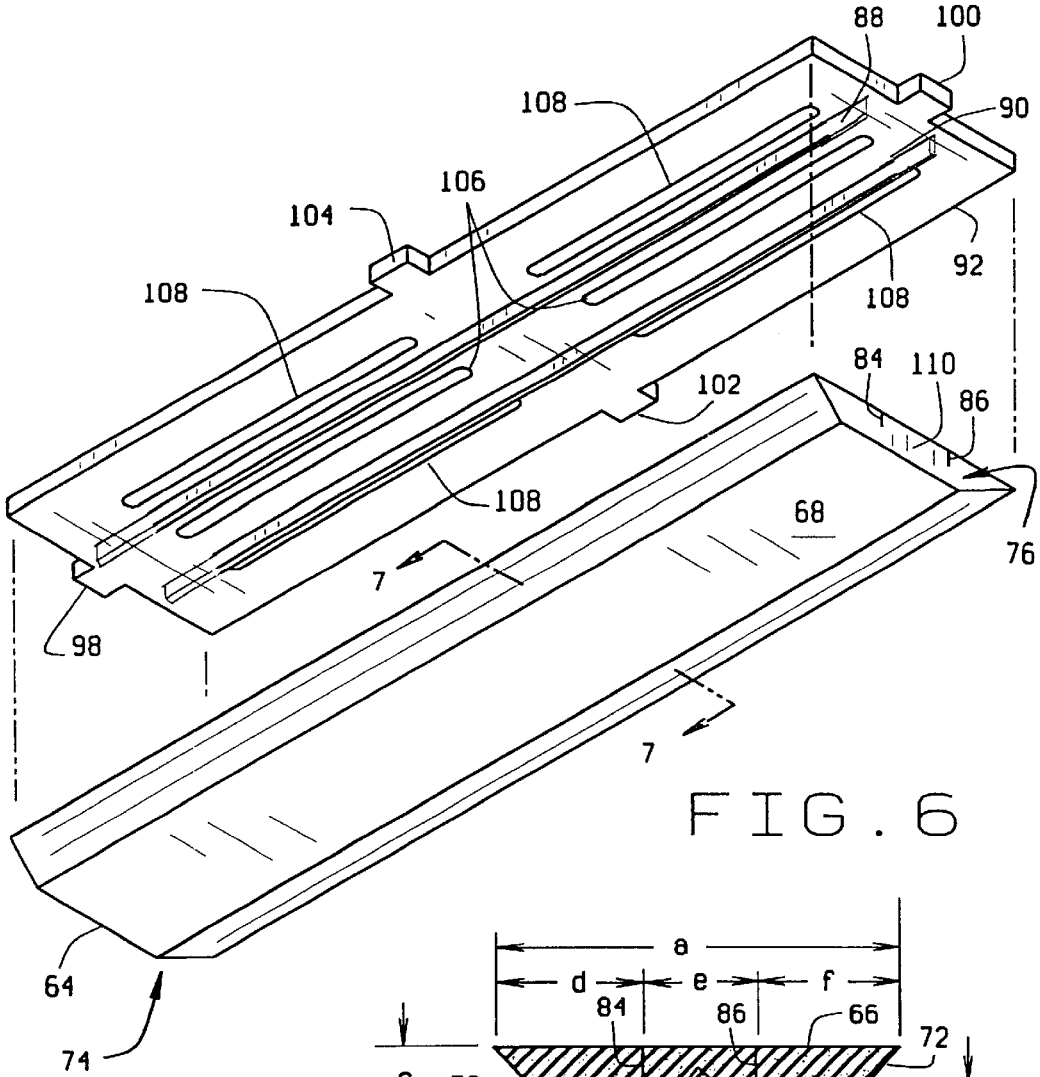
FIG. 6 is an exploded view of the replaceable cleaning assembly of the present invention.
Figure 7:
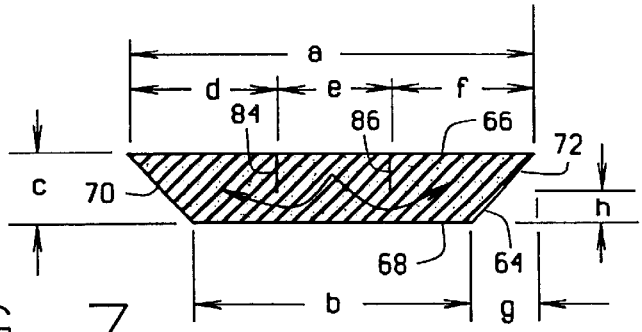
FIG. 7 is a cross-sectional view taken along line 7—7 of the sponge of the present invention.
Figure 8:
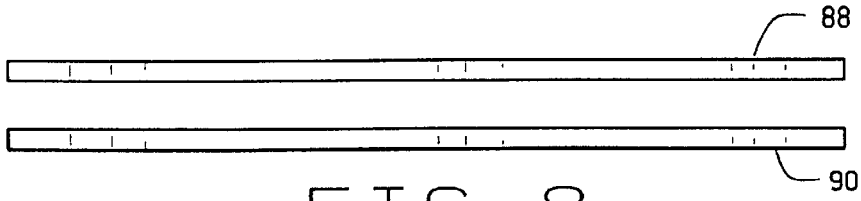
FIG. 8 is a plan view of two fluid barriers of one embodiment of the present invention.

As best shown in FIGS. 1, 6, 7 and 8, replaceable cleaning assembly 62 comprises sponge 64, first fluid barrier 88, second fluid barrier 90, backing plate 92, and moisture barrier 110. Specifically, sponge 64 is provided with a rectangular top surface 66, rectangular bottom surface 68, first angled side 70, second angled side 72, first end 74, and second end 76. Sponge 64 has a trapezoidal cross sectional area, as shown in FIG. 7. Thus, the area of rectangular top surface 66 is greater than the area of rectangular bottom surface 68. Preferably, sponge 64 is an open cell sponge, having a pore structure of approximately 60 to 90 ppi with a preferred structure of approximately 77 ppi.

Sponge 64 has first slit 84 and spaced apart second slit 86, both disposed longitudinally along top surface 66 of sponge 64. As shown best in FIG. 7, first slit 84 and second slit 86 extend from top surface 66 towards bottom surface 68. However, it can be seen that the slits, 84 and 86 do not extend all the way to bottom surface 68. To make the extension of slits 84 and 86 clear, the following preferred dimensions are provided. Specifically, dimension a is 2.05 inches, dimension b is 1.63 inches, dimension c is 0.50 inches, dimension d is 0.69 inches, dimension e is 0.69 inches, dimension f is 0.68 inches, dimension h is 0.12 inches, and the depth of slits 84 and 86 are 0.38 inches.

As seen in FIG. 6, the ends 74 and 76 of sponge 64 are preferably provided with a moisture barrier 110. Moisture barrier 110 may be closed cell foam, sealing tape, epoxy or any other material that prevents the egress of water.

First fluid barrier 88 and second fluid barrier 90 are preferably permanently inserted into slits 84 and 86 of sponge 64. First and second fluid barriers, 88 and 90, may be a rectangular section of thin plastic, epoxy, or glue (such as 3M epoxy, DP-105 clear), or any other material that provides a fluid barrier. However, another limitation on the fluid barrier is that it must not cut through the sponge 64. The proposed plastic material for the fluid barriers 88 and 90, respectively, may be between 1–4 mm thick.

Backing plate 92 has a top surface 94, bottom surface 96, first end tab 98, second end tab 100, first side tab 102, second side tab 104, fluid delivery openings 106, and fluid suction openings 108. Bottom surface 96 of backing plate 92 is textured to enhance the permanent fixation (gluing) of bottom surface 96 of backing plate 92 to top surface 66 of sponge 64. In addition, fluid barriers 88 and 90 may be integral to backing plate 92 as shown in FIG. 6 and inserted into slits 84 and 86 upon assembly of the backing plate 92 with the sponge 64. Alternatively, fluid barriers 88 and 90 may be separate from and not affixed to or part of the backer plate 92 at all.

In operation, the replaceable cleaning assembly 62 is first attached to cleaning tool housing assembly 12. Specifically, first side tab 102 and second side tab 104 are grasped by the user. Then first end tab 98 is inserted into first end hole 48 of manifold body 34. Then second end tab 100 is inserted into second end hole 50 of manifold body 34. Then, replaceable cleaning assembly 62 is released, and first side tab 102 and second side tab 104 are released into first side gap 44 and second side gap 46 of manifold body 34. The assembly portion of the operation is completed. It is assumed that the cleaning tool housing assembly 12 is already connected to a source of pressurized fluid via connection to fluid intake element 30, and already connected to a source of negative vacuum pressure via fitting 13 of cleaning tool housing 14.

Next, the cleaning tool 10 needs to be used. Accordingly, the source of pressurized fluid and the source of negative pressure are both activated (i.e. the cleaning machine is turned on). Upon activation, pressurized fluid enters fluid intake element 30, and travels into longitudinal channel 38. The fluid would be retained within longitudinal channel 38 due to the constraints imposed by the location of fluid intake element 30 directly above longitudinal channel 38. However, holes 40 within longitudinal channel 38 ensure that fluid is forced out by hydraulic pressure through fluid delivery openings 54 of gasket 52, through fluid delivery openings 106 of backing plate 92 into sponge 64. Gasket 52 creates a seal between the source of negative pressure and the source of pressurized fluid.

As is evident from FIGS. 5A, 5B, 6 and 7, pressurized fluid enters the sponge in the area covered by dimension e. As the pressurized fluid enters through top surface 66 of sponge 64, negative pressure is being exerted through sponge 64 in the areas covered by dimension d and dimension f. However, this negative pressure is unable to draw fluid through fluid barriers 88 and 90. Thus, for the depth of insertion of fluid barriers 88 and 90, fluid is pushed forward through sponge 64.

Once the pressurized fluid is past the fluid barriers 88 and 90, the fluid reaches bottom surface 68 where it is used in conjunction with a wiping or scrubbing action by manipulation of the sponge. Dirty (used) cleaning fluid may be pulled back into sponge 64 due to negative pressure into the areas marked by dimension d and dimension f. Accordingly, the fluid path through sponge 64 is illustrated by the arrows indicated on the sponge 64. It is pointed out that a steady volume of cleaning fluid flow is produced that reaches bottom surface 68 of sponge 64.

The trapezoidal cross section of sponge 64 provides some benefits. First, if the cross section had been rectangular, the negative pressure may be unable to pull cleaning fluid from the farther corner edges of the sponge 64. When the cleaning fluid is not circulated properly, the sponge retains unpleasant dirty corner edges. In addition, any retention of cleaning fluid that is not returned by negative pressure will result in a buildup of excess cleaning fluid within the sponge. This situation results in droplet formation, and dripping on the surface that is being cleaned. Accordingly, with the chamfered sponge sides, 70 and 72, respectively, cleaning fluid is able to circulate through substantially the entire sponge 64 cross section. This avoids an unsightly sponge appearance and prevents dripping. Second, the trapezoidal cross section facilitates use of the tool as the corner edges do not impede the movement of the tool across the surface to be cleaned by, for example, rolling up under the tool as it is pulled along the surface.

Once fluid is drawn back by negative pressure to top surface 66 of sponge 64, the fluid is pulled through fluid suction openings 108 of backing plate 92, pulled through fluid suction openings 56 of gasket 52, and pulled through first and second longitudinal openings 37 and 39 respectively. Then, the fluid travels to openings 17 and 23, respectively, of first and second nozzles 16 and 22, respectively, and then into the interior of cleaning tool housing 14.

In examining the preferred pressurized fluid rates, both positive and negative, it is preferred that the fluid be pressurized at a rate of between 0.4 and 0.55 gallons per minute. In addition, it is preferred that the negative pressure, or vacuum, is between 94 and 104 inches of water lift at the interior of the housing 14.

It will be seen that the description of the present invention provides a broad inventive concept. It is the intention that the description is written to provide a clear and complete understanding of the invention, and should not be interpreted to limit the scope of the claims in any way.

What is claimed is:

1. A cleaning tool comprising:

a cleaning tool housing assembly having a body which is hollow, a first nozzle connected to said body, a second nozzle connected to said body, a manifold body provided with first and second longitudinal openings and holes, a fluid intake element connected to said manifold body in communication with said holes, and a gasket connected to said manifold body, said gasket having fluid intake openings and fluid delivery openings;

wherein said first nozzle is provided with an opening in communication both with said hollow of said body and said first longitudinal opening of said manifold body, said second nozzle is provided with an opening in communication both with said hollow of said body and said second longitudinal opening of said manifold body;

a cleaning tool assembly connected to said cleaning tool housing, said cleaning tool assembly having a backing plate defining at least one fluid delivery opening and defining at least two fluid suction openings, said cleaning tool assembly further having a sponge fixed to said backing plate, and having first and second fluid barriers each disposed longitudinally within said sponge, and each extending from one surface of said sponge towards another surface;

wherein fluid may be delivered through said fluid intake element through said holes of said manifold, through said fluid delivery openings of said gasket, through said fluid delivery openings of said backing plate, and through said sponge between said first and second fluid barriers;

and wherein said fluid may flow around said first and second fluid barriers, through said fluid suction openings of said backing plate, through said fluid suction openings of said gasket, through said longitudinal openings of said manifold, through said openings of said first and second nozzles, and into said hollow of said body.

2. A cleaning tool according to claim 1, wherein each of said fluid barriers comprise a rectangular plastic segment.

3. A cleaning tool according to claim 1 wherein each of said fluid barriers comprise an epoxy material.

4. A cleaning tool element comprising:

a sponge having a rectangular top surface, a rectangular bottom surface, a first side disposed between said rectangular top surface and said rectangular bottom surface, a second side disposed between said rectangular top surface and said rectangular bottom surface, a first end, and a second end;

a first fluid barrier disposed longitudinally in said sponge extending from said top surface towards and spaced from said bottom surface; and a second fluid barrier disposed longitudinally in said sponge spaced apart from said first fluid barrier, extending from said top surface towards and spaced from said bottom surface;

a first moisture barrier disposed on said first end of said sponge; and a second moisture barrier disposed on said second end of said sponge.

5. A cleaning element according to claim 4, wherein said first moisture barrier comprises closed cell rubber.

6. A cleaning element according to claim 4, wherein said first moisture barrier comprises a sealing tape.

7. A cleaning element according to claim 4, wherein said first moisture barrier comprises an epoxy.

8. A cleaning element comprising:

a sponge having a trapezoidal cross section, a rectangular top surface, a rectangular bottom surface, a first angled side disposed between said rectangular top surface and said rectangular bottom surface, a second angled side disposed between said rectangular top surface and said rectangular bottom surface, a first end, and a second end;

a first slit disposed longitudinally along said top surface extending from said top surface towards and spaced from said bottom surface;

a second slit disposed longitudinally along said top surface and spaced from said first slit, said second slit extending from said top surface towards and spaced from said bottom surface.

9. A cleaning element according to claim 8, further comprising:

a first fluid barrier disposed in said first slit; and a second fluid barrier disposed in said second slit.

10. A cleaning element comprising:

a sponge having a trapezoidal cross section, a rectangular top surface, a rectangular bottom surface, a first angled side disposed between said rectangular top surface and said rectangular bottom surface, a second angled side disposed between said rectangular top surface and said rectangular bottom surface, a first end, and a second end;

a first moisture barrier disposed on said first end of said sponge; and a second moisture barrier disposed on said second end of said sponge.

11. A cleaning element according to claim 10, wherein said first moisture barrier comprises closed cell rubber.

12. A cleaning element according to claim 10, wherein said first moisture barrier comprises a sealing tape.

13. A cleaning element according to claim 10, wherein said first moisture barrier comprises an epoxy.

14. A cleaning tool housing comprising:

a hollow housing body;

a first nozzle having a first end and a second end with an opening extending from said first end to said second end, said second end of said first nozzle being connected to said housing body so that said opening of said first nozzle communicates with the interior of said housing body;

a second nozzle having a first end and a second end with an opening extending from said first end to said second end, said second end of said second nozzle being connected to said housing body so that said opening of said second nozzle communicates with the interior of said housing body; and a manifold connected to said first end of said first nozzle and connected to said first end of said second nozzle, said manifold having a plurality of longitudinal openings;

wherein the area of said opening at the second end of said first nozzle is smaller than the area of said opening at the first end of said first nozzle;

wherein the area of said opening at the second end of said second nozzle is smaller than the area of said opening at the first end of said second nozzle;

wherein one of said longitudinal openings of said manifold communicates with said opening of said first nozzle; and wherein one of said longitudinal openings of said manifold communicates with said opening of said second nozzle.

15. A cleaning tool housing according to claim 14, further comprising:

a fluid intake element attached to said manifold;

said manifold having a longitudinal channel, and having at least one hole in said longitudinal channel;

wherein said fluid intake element is disposed above said longitudinal channel of said manifold.

* * * * *